US005379460A

United States Patent [19]

Aoki

[11] Patent Number: 5,379,460

[45] Date of Patent: Jan. 10, 1995

[54] AN ADJUSTABLE BALL CATCHING APPARATUS

[75] Inventor: Akio Aoki, Osaka, Japan

[73] Assignee: Trion Corporation, Osaka, Japan

[21] Appl. No.: 24,804

[22] Filed: Mar. 1, 1993

Related U.S. Application Data

[63] Continuation of Ser. No. 784,966, Oct. 30, 1991, abandoned.

[30] Foreign Application Priority Data

Nov. 1, 1990 [JP] Japan ..... 2-115067[U]

[51] Int. Cl.[6] ..... A41D 13/08

[52] U.S. Cl. ..... 2/19; 2/161.1

[58] Field of Search ..... 2/19, 16, 161.1, 159, 2/160, 20

[56] References Cited

U.S. PATENT DOCUMENTS

| | | | |
|---|---|---|---|
| D. 213,285 | 2/1969 | Khazzam | 2/19 X |
| 1,552,080 | 9/1925 | Rainey | 2/19 |
| 1,756,377 | 4/1930 | Nolte | 2/19 |
| 2,414,004 | 1/1947 | Turner | 2/19 |
| 2,510,218 | 6/1950 | Goldsmith et al. | 2/19 |
| 3,576,036 | 4/1971 | Latina | 2/19 |
| 3,721,996 | 3/1973 | Nadorf | 2/19 |
| 3,898,696 | 8/1975 | Campanis | 2/19 |
| 3,909,848 | 10/1975 | Brockman | 2/19 |
| 4,720,875 | 1/1988 | Latina et al. | 2/19 |
| 5,031,239 | 7/1991 | Panichello | 2/19 |

FOREIGN PATENT DOCUMENTS

| | | | |
|---|---|---|---|
| 685446 | 4/1964 | Canada | 2/19 |

*Primary Examiner*—Clifford D. Crowder
*Assistant Examiner*—Larry D. Worrell, Jr.
*Attorney, Agent, or Firm*—Webb Ziesenheim Bruening Logsdon Orkin & Hanson

[57] ABSTRACT

A glove for catching a baseball, a softball, or the like, which comprises a main body for receiving the user's hand, and a ball catching member disposed between thumb and forefinger portions. Connecting portions are provided in the ball catching member and include a plurality of holes arranged along a longitudinal direction of the user's fingers for receiving a strap which interconnects the thumb and the forefinger portions and the main body. A plurality of holes arranged along the longitudinal direction of the user's fingers are provided in lines between the thumb and forefinger portions for selectively receiving the strap.

6 Claims, 5 Drawing Sheets

AN ADJUSTABLE BALL CATCHING APPARATUS

This is a continuation of copending application Ser. No. 07/784,966 filed on Oct. 30, 1991, now abandoned.

BACKGROUND OF INVENTION

1. Field of the Invention

The present invention relates to a ball catching apparatus as used in a baseball, a softball or the like, which comprises a main body for receiving a hand, and a ball catching member disposed between a thumb receiving portion and a forefinger receiving portion provided in the main body, respectively.

2. Description of the Related Art

As shown in FIG. 9, in the general conventional ball catching apparatus, the ball catching member 40' is attached to the thumb receiving portion 20' and the forefinger receiving portion 30' by inserting a strap 220' through a plurality of loops **40*a*' defined in a periphery of the ball catching member 40' and a plurality of holes 100' defined in end portions of the respective receiving portions 20' and 30'. A space between the thumb receiving portion 20' and the forefinger receiving portion 30'** is determined by balls having different diameters to each other, e.g. a baseball, a softball or the like.

In order to vary the space between the thumb receiving portion 20' and the forefinger receiving portion 30', a plurality of ball catching members 40' having different widths to each other are required in order to replace the one with the other, which results in wasteful increase of the number of the parts.

SUMMARY OF THE INVENTION

A primary object of the present invention is to provide a ball catching apparatus usable for a long term for solving the above-noted problem, in which a space between a thumb receiving portion and a forefinger receiving portion is freely adjustable.

The present invention is characterized by a ball catching apparatus comprising a main body for receiving a hand, ball catching means disposed between a thumb receiving portion and a forefinger receiving portion formed in the main body, respectively, and divided into a plurality of catching elements between the thumb receiving portion and the forefinger receiving portion, and connecting portions provided in the plurality of catching elements and including a plurality of holes arranged along a longitudinal direction of fingers for receiving a strap, thereby to interconnect the plurality of catching elements adjacent with each other, wherein the plurality of holes arranged along the longitudinal direction of the fingers are provided, at least in one of the connecting portions, in lines in a spacing direction between the thumb receiving portion and the forefinger receiving portion for selectively receiving the strap.

The present invention is further characterized by a ball catching apparatus comprising a main body for receiving a hand, ball catching means disposed between a thumb receiving portion and a forefinger receiving portion defined in the main body, respectively, and connecting portions provided in the ball catching means and including a plurality of holes arranged along a longitudinal direction of fingers for receiving a strap, thereby to interconnect the thumb receiving portion, the forefinger receiving portion and the main body, wherein the plurality of holes arranged along the longitudinal direction of fingers are provided, at least one of the connecting portions, in lines in a spacing direction between the thumb receiving portion and the forefinger receiving portion for selectively receiving the strap.

According to either of the characteristic features, as seen from FIGS. 1, 5 and 7, at least one of the series of holes 7, 9, 7', 9', 80 and 100 defined in the connecting portions **5*x*, 6*x*, 5*x'* and 6*x'* of the ball catching members 5, 6, 5', 6' and 40, respectively, is arranged in lines 7*a*, 7*b*, 9*a*, 9*b*, 80*a*, 80*b*, 100*a* and 100*b*. Thus, either of the plurality of lines can be selected to interconnect the ball catching members 5, 6, 5', 6' and 40, which does not requires that the ball catching member is replaced with another ball catching member of different width. In this case, the connecting portions 5*x*, 6*x*, 5*x'*, 6*x'* and 40*x'* of the ball catching members 5, 6, 5', 6' and 40 can be closely interconnected through the strap 21**, as a result of which a shock occurred in catching a ball is dispersed in the connecting portions adjacent the hole lines thereby to protect the holes and the strap from damaging and thus enhance the durability of the apparatus. The enhancement of the connecting portions may considerably prevent the strap from breaking inadvertently. Even if the strap breaks, the close connection through the strap between the connecting portions of the ball catching member allows the user to catch the ball without facing any dangers.

Thus, the present invention can provide an inexpensive ball catching apparatus having a simple and economic structure and usable safely for a long term while the space between the thumb receiving portion and the forefinger receiving portion is freely adjustable in response to the ball to be used simply by variously selecting the plurality of hole lines for receiving the strap.

Other objects, structures and advantages will be apparent from the following description.

BRIEF DESCRIPTION OF DRAWINGS

FIG. 1 through 8 show a ball catching apparatus embodying the present invention in which:

FIGS. 1(*a*), (*b*) and (*c*) are fragmentary front views of the ball catching apparatus according to a first embodiment of the present invention;

FIG. 2 is an exploded perspective view of the ball catching apparatus of FIG. 1;

FIG. 3 is a fragmentary exploded perspective view of a modified example of the first embodiment;

FIG. 4 is a fragmentary front view of the ball catching apparatus according to a second embodiment of the present invention;

FIG. 5 is a fragmentary rear view of the ball catching apparatus of FIG. 4;

FIG. 6 is a fragmentary exploded perspective view of the ball catching apparatus of FIG. 4;

FIG. 7 is a fragmentary front view of the ball catching apparatus according to a third embodiment of the present invention; and FIG. 8 is a fragmentary rear view of a modified example of the ball catching apparatus of FIG. 7.

DESCRIPTION OF THE PREFERRED EMBODIMENTS

A first embodiment of the present invention will be described in detail referring to FIGS. 1 and 2.

Figure 1:
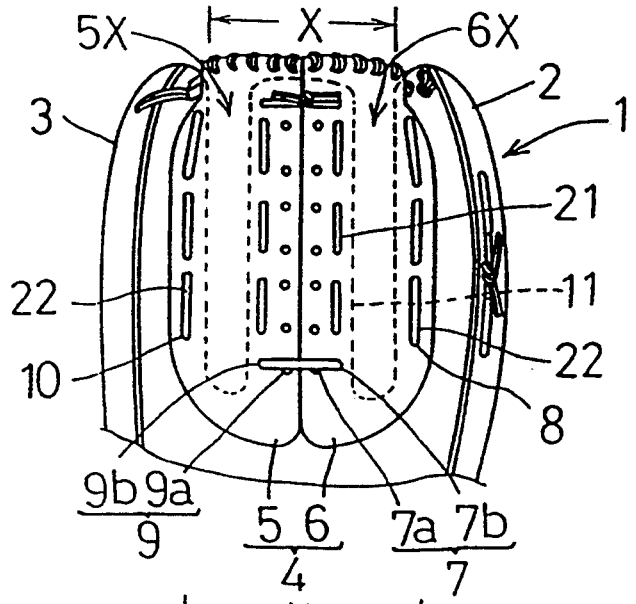
Figure 1:
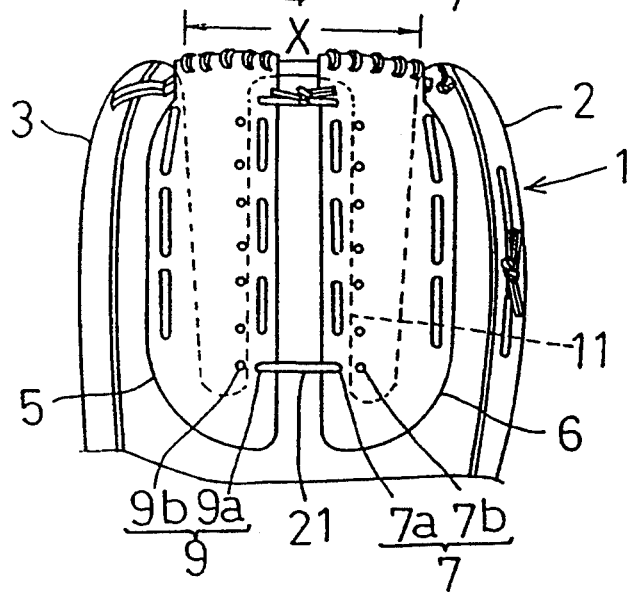
Figure 1:
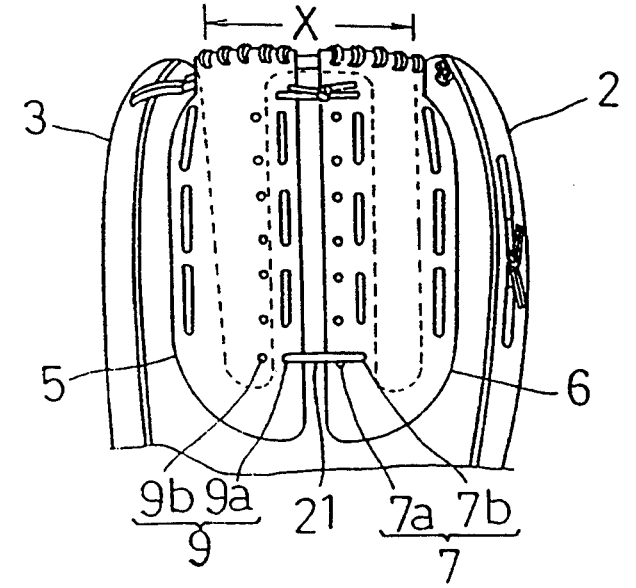
Figure 2:
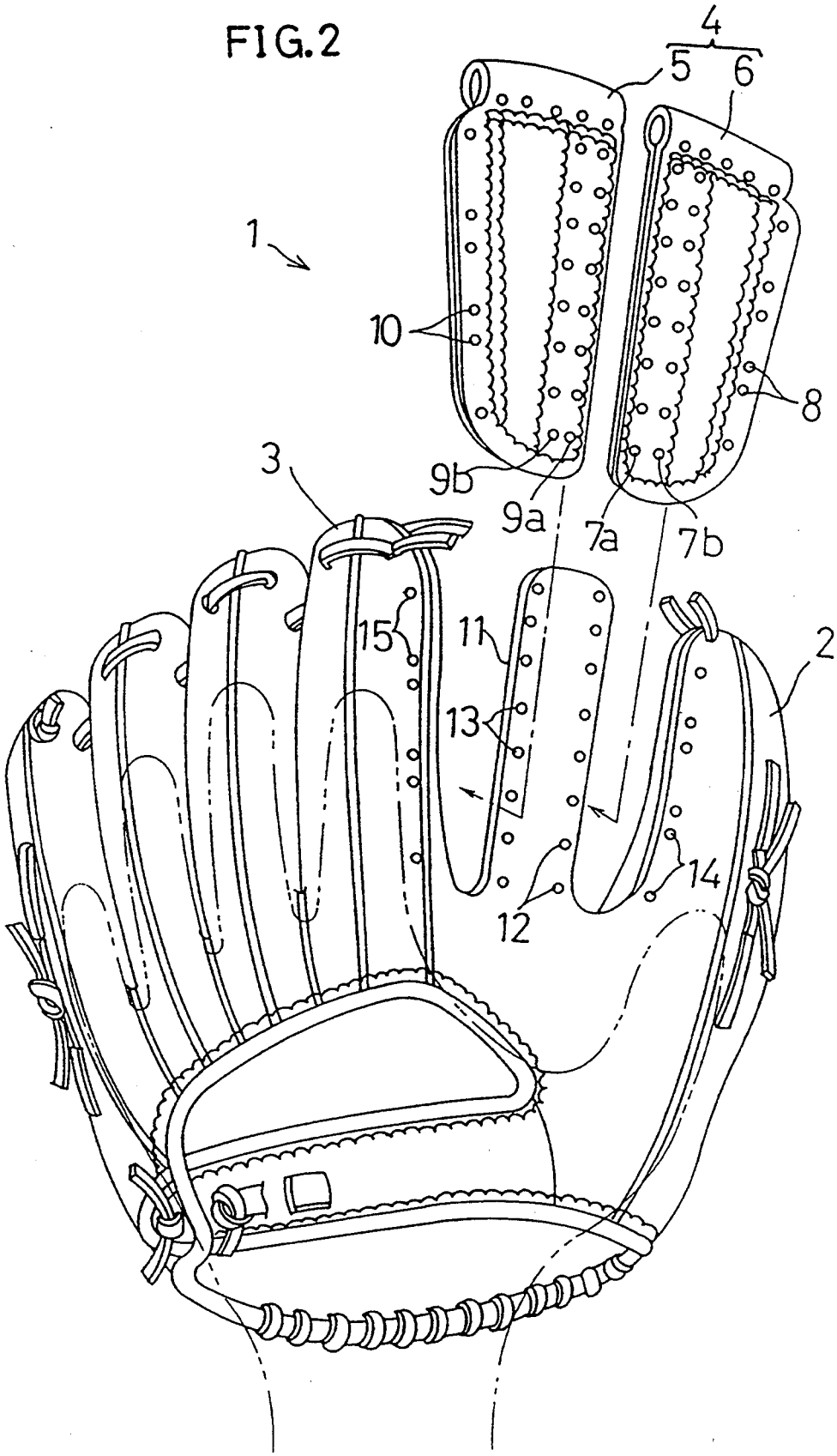

As shown in FIG. 1, a ball catching apparatus comprises a main body 1 for receiving a hand including a thumb receiving portion 2 and a forefinger receiving portion 3, and a ball catching member 4 disposed between the thumb receiving portion and the forefinger receiving portion. As shown in FIGS. 1(*a*) and 2, the ball catching member 4 is divided into a first catching element 5 attached to the forefinger receiving portion 3 and a second catching element 6 attached to the thumb receiving portion 2. A support member 11 projects from the main body 1 between the thumb receiving portion 2 and the forefinger receiving portion 3.

The first and second catching elements 5 and 6 includes connecting portions 5*x* and 6*x* to the forefinger receiving portion 3 and the thumb receiving portion 2, respectively, defining a series of holes 8 and 10 along a direction of the thumb or the forefinger. A strap 22 is inserted through these holes 8 and 10 and a series of holes 14 and 15 defined in connecting portions of the thumb receiving portion 2 and the forefinger receiving portion 3, respectively, opposing to the connecting portions 5*x* and 6*x* thereby to connect the first and second catching elements 5 and 6 to the forefinger receiving portion 3 and the thumb receiving portion 2. At inner end portions of the connecting portions 5*x* and 6*x* where the first and second catching elements 5 and 6 are positioned adjacent with each other, a series of holes 7 and 9 are arranged along the direction of the thumb or the forefinger. A strap 21 is inserted through these holes 7 and 9 and a series of holes 12 and 13 defined in the support member 11 thereby to interconnect the first and second catching elements 5 and 6.

The series of holes 7 and 9 defined in the inner end portions of the connecting portions are arranged in lines 7*a*, 7*b*, 9*a* and 9*b* in a spacing direction between the thumb receiving portion 2 and the forefinger receiving portion 3 thereby to form an adjusting mechanism for adjusting a space between the thumb receiving portion 2 and the forefinger receiving portion 3 (referred as a ball catching space X hereinafter). FIG. 1(*a*) shows the smallest ball catching space X as employed in catching a baseball, which utilizes the outer hole lines 7*b* and 9*b*. On the contrary, FIG. 1(*b*) shows the largest ball catching space X as employed in catching a softball having a larger diameter, which utilizes the inner hole lines 7*a* and 9*a*. In catching a ball having an intermediate diameter, the outer hole line 7*b* and the inner hole line 9*a* can be used as shown in FIG. 1(*c*).

Figure 4:
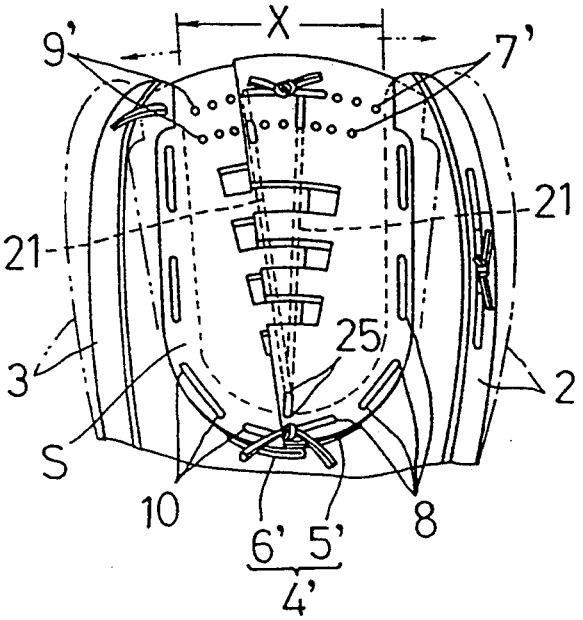
Figure 5:
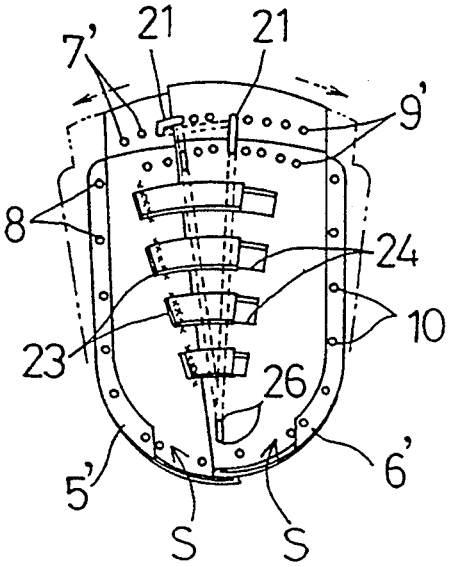
Figure 6:
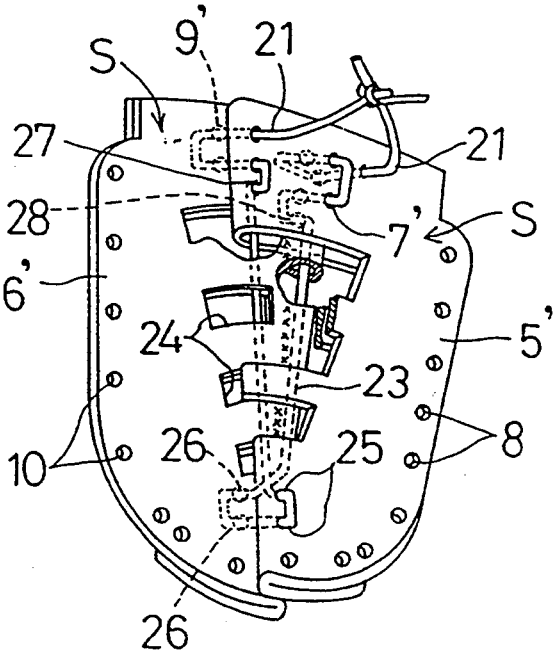

A second embodiment of the present invention will be described next referring to FIGS. 4 through 6.

A ball catching member 4′ includes a first and second catching elements 5′ and 6′ connected to the thumb receiving portion 2 and the forefinger receiving portion 3 through holes 8 and 10 defined over a periphery of the ball catching member except an opening portion between the thumb receiving portion 2 and the forefinger receiving portion 3.

Each of the first and second catching elements 5′ and 6′ is formed of a piece of leather folded at a side opposing to the other part and stitched up in a periphery S to form a twofold structure. The strap 21 is inserted through holes 25 and 26 defined in the first and second catching elements 5′ and 6′, respectively, thereby to pivotably interconnect the first and second catching elements at a side of the palm.

From the first catching element 5′ project segmental engaging elements 23 centering around the pivotal holes 25. The engaging elements 23 are inserted from the back through segmental engaging openings 24 defined in the second catching element 6′ centering around the pivotal holes 26, and folded back toward the thumb to be stitched up at the side of the palm thereby to engage the first catching element 5′ with the second catching element 6′ to be relatively movable with each other.

A series of holes 7′ and 9′ arranged along the direction of the thumb or forefinger are defined in lines in fingertip portions of the connecting portions 5X and 6X of the first and second catching elements 5′ and 6′ to form segments centering around the pivotal holes 26, thereby to adjust the ball catching space X. The strap 21 is inserted into the twofold first and second catching elements 5′ and 6′, and is restricted in movement by facing portions of the first and second catching elements 5′ and 6′ stitched up to form sleeves, respectively. The strap 21 is also inserted through positioning holes 27 and 28 defined in the fingertip portions thereby to be fixed in position relative to the first and second catching elements 5′ and 6′.

Thus, the positionally fixed strap 21 is inserted through the lines of holes 7′ and 9′ thereby to interconnect the first and second catching elements 5′ and 6′, part of which is overlapped with each other. As shown in FIGS. 4 and 5, the first and second catching elements 5′ and 6′ are relatively moved about the pivotal holes 25 and 26, and the strap 21 is inserted through the corresponding holes 7′ and 9′ in that condition thereby to adjust the ball catching space X.

Figure 7:
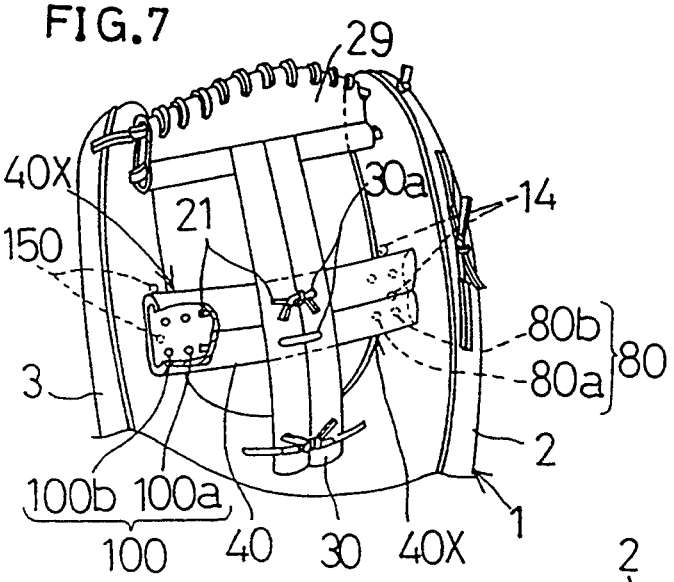

A third embodiment will be described next referring to FIG. 7.

A first ball catching member 40 extends between intermediate portions of the thumb receiving portion 2 and the forefinger receiving portion 3, and a second ball catching member 29 extends between extreme end portions of the thumb receiving portion 2 and the forefinger receiving portion 3, respectively. Further, a third ball catching member 30 connectably extends over the intermediate portion of the first ball catching member 40, the intermediate portion of the second ball catching member 29, and the main body 1 thereby to form a ball catching portion between the thumb receiving portion 2 and the forefinger receiving portion 3.

The first ball catching member 40 has a twofold structure and defines connecting holes 30*a* to the third ball catching member 30 in a central portion thereof, and connecting holes 80 and 100 to the intermediate portions of the thumb receiving portion 2 and the forefinger receiving portion 3 in opposite connecting end portions thereof. The strap 21 is inserted through these holes 80 and 100 to be positioned inside the twofold first ball catching member 40 and further through holes 140 and 150 defined in the intermediate portions of the thumb receiving portion 2 and the forefinger receiving portion, respectively, and the connecting holes 30*a* defined in the third ball catching member 30 thereby to connect between the members as noted above.

The series of holes 80 and 100 defined in the opposite connecting end portions 40X of the first ball catching member 40 are formed in lines 80*a*, 80*b*, 100*a* and 100*b* in a spacing direction between the thumb receiving portion 2 and the forefinger receiving portion 3, respectively. In a similar matter to the first embodiment, the space X of the ball catching portion between the intermediate portions of the thumb receiving portion 2 and the forefinger receiving portion 3 can be adjusted by selectively using either of these hole lines 80*a*, 80*b*, 100*a* and 100*b*.

Figure 3:
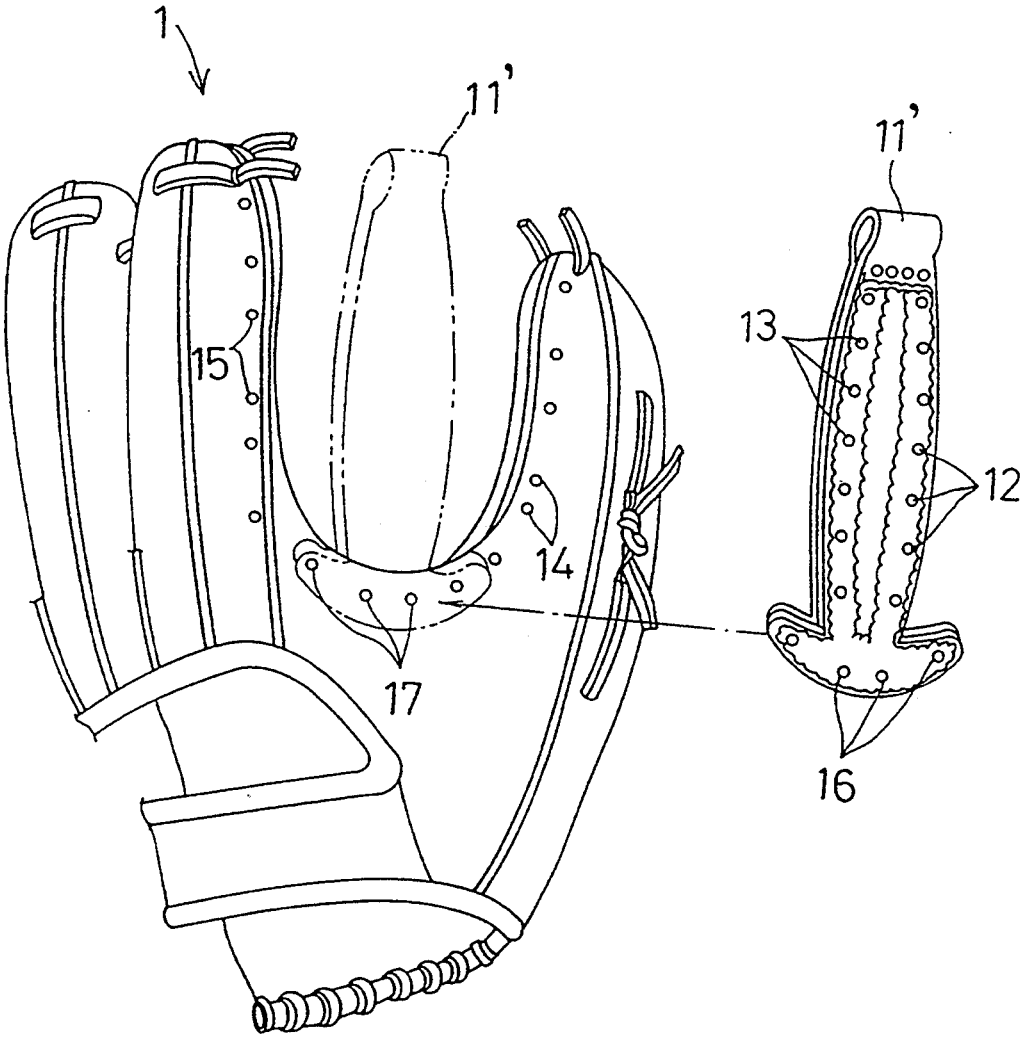

The support member in the first embodiment may be formed by a support element 11' separated from and connected to the main body 1 by the strap inserted through holes 16 and 17 defined in the support element and the main body, respectively, as shown in FIG. 3.

Figure 8:
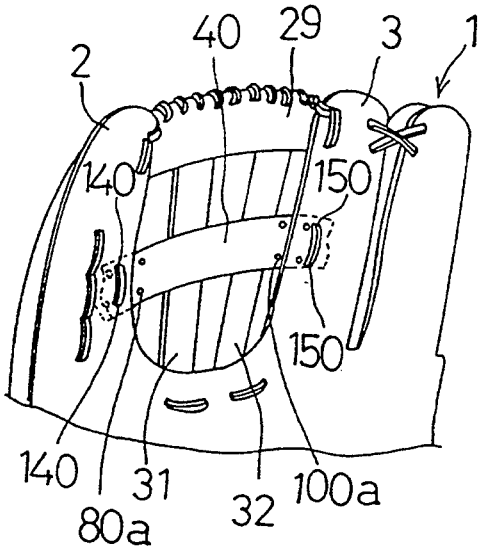
Figure 9:
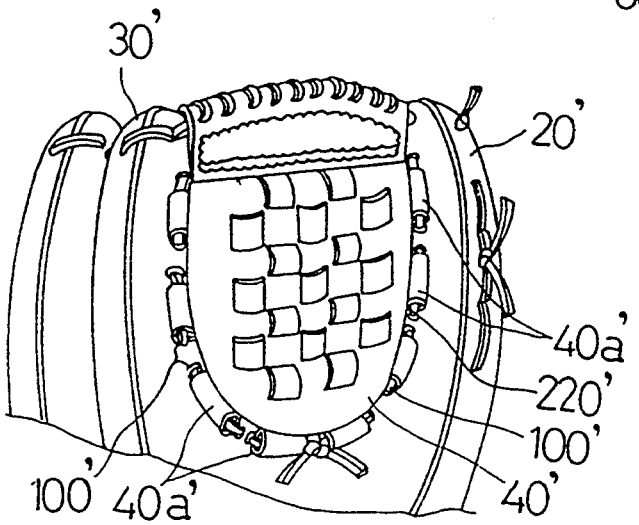
(PRIOR ART) FIG.9
FIG. 9 is a fragmentary front view showing the conventional ball catching apparatus.

The third ball catching member 30 in the third embodiment may include two elements 31 and 32 as shown in FIG. 8.

In the first embodiment, the first and second catching elements 5 and 6 are interconnected through the support member 11, but may be overlapped to be directly interconnected without providing the support member 11.

The ball catching member 4 and 4' in the first and second embodiments may be divided into more than three parts to form separate catching elements.

A direction for dividing the ball catching member need not be completely consistent with the spacing direction between the thumb receiving portion 2 and the forefinger receiving portion 3.

Similarly, a direction of the individual line of holes for adjusting the ball catching space X need not be completely consistent with the direction of the thumb or the forefinger.

What is claimed is:

1. A ball catching apparatus comprising:

a main body for receiving a hand including a thumb receiving portion;

a forefinger receiving portion;

a connecting support member integrally formed with said body, said connecting support member projecting from said main body, said connecting support member having an extreme end positioned inwardly of extreme ends of said thumb and said forefinger receiving portions;

a ball catching means including a first ball catching element and a second ball catching element;

said first ball catching element having a plurality of holes for tightly interconnecting said first ball catching element and said forefinger receiving portion, and a plurality of adjustment holes provided in lines for interconnecting said first ball catching element and said connecting support member;

said second ball catching element having a plurality of holes for tightly interconnecting said second ball catching element and said thumb receiving portion, and a plurality of adjustment holes provided in lines for interconnecting said second ball catching element and said connecting support member;

connecting portions provided in each of said first and second ball catching elements to interconnect said first and second ball catching elements;

said plurality of adjustment holes provided in lines of said first and second ball catching elements being arranged along a longitudinal direction of said thumb and said forefinger receiving portions; and a strap receivable in some of said plurality of adjustment holes provided in lines of said first and second ball catching elements to interconnect said first and second ball catching elements;

wherein said plurality of adjustment holes provided in lines of said first and second ball catching elements may selectively receive said strap to vary the width of said ball catching means.

2. A ball catching apparatus comprising:

a main body for receiving a hand including a thumb receiving portion and a forefinger receiving portion;

a ball catching means including a first ball catching element and a second ball catching element;

said first ball catching element having a plurality of holes for interconnecting said first ball catching element and said thumb receiving portion, a plurality of adjustment holes provided in rows for interconnecting said first ball catching element and said second ball catching element, and pivot holes;

said second ball catching element having a plurality of holes for interconnecting said second ball catching element and said forefinger receiving portion, a plurality of adjustment holes provided in rows for interconnecting said second ball catching element and said first ball catching element, and pivot holes;

said first and second ball catching elements pivotably interconnected to each other at said pivot holes, and said first and second ball catching elements having folded-back double structures and interconnected with each other;

one of said ball catching elements defining a plurality of segmental engaging openings centered around said pivot holes, the other of said ball catching elements defining a plurality of segmental projections centering around said pivot holes, said projections being inserted through said plurality of engaging openings and folded back; and a strap for interconnecting said first and second ball catching elements with each other;

wherein said plurality of adjustment holes provided in rows of said first and second ball catching elements may selectively receive said strap to vary the width of said ball catching means.

3. A ball catching apparatus comprising:

a main body for receiving a hand including a thumb receiving portion and a forefinger receiving portion;

a ball catching element formed of a first ball catching member, a second ball catching member, and at least one third ball catching member;

said first ball catching member having a double structure for interconnecting an intermediate portion of said thumb receiving portion and an intermediate portion of said forefinger receiving portion with each other, said first ball catching member having a first plurality of holes provided in one side thereof in spaced lines for selectively connecting said thumb receiving portion in at least two distinct positions and a second plurality of holes provided in the other side thereof in spaced lines for selectively connecting said forefinger receiving portion in at least two distinct positions, wherein said selectively connecting said first ball catching member with said thumb receiving portion and said forefinger receiving portion will vary the width of said ball catching element;

a second ball catching member for interconnecting said thumb and said forefinger receiving portions with each other at extreme ends thereof;

at least one third ball catching member for interconnecting an intermediate portion of said first ball catching member, an intermediate portion of said second ball catching member, and said main body; and a strap for interconnecting said main body and said first ball catching member, and interconnecting said first ball catching member and said third ball catching member;

wherein said strap passes through inside said first ball catching member to interconnect said first ball catching member and said main body.

4. A ball catching apparatus as claimed in claim 3 further comprising a plurality of said third ball catching members.

5. A ball catching apparatus comprising:

a main body for receiving a hand including a thumb receiving portion and a forefinger receiving portion;

a ball catching means disposed between said thumb receiving portion and said forefinger receiving portion and which is divided into a plurality of catching elements;

connecting portions provided in each of said plurality of catching elements and including a plurality of holes arranged along a longitudinal direction of said thumb receiving portion and said forefinger receiving portion;

a strap receivable in some of said plurality of holes to interconnect said plurality of catching elements with each other;

wherein said plurality of holes are provided, at least in one of said connecting portions, in lines spaced from each other in a direction extending between said thumb receiving portion and said forefinger receiving portion, whereby said plurality of holes may selectively receive said strap to vary the width of said ball catching means;

wherein said plurality of catching elements overlap each other and are pivotally attached to each other.

6. A ball catching apparatus as claimed in claim 5 wherein said plurality of catching elements are pivotably overlapped at a side of the palm to be interconnected to each other through said strap.

* * * * *